US009706863B2

(12) United States Patent
Huang

(10) Patent No.: US 9,706,863 B2
(45) Date of Patent: Jul. 18, 2017

(54) THERMO MUG

(71) Applicant: Guangzhou Hekoumei Houseware Development Co., Ltd., Guangdong (CN)

(72) Inventor: Wei Huang, Guangdong (CN)

( * ) Notice: Subject to any disclaimer, the term of this patent is extended or adjusted under 35 U.S.C. 154(b) by 0 days.

(21) Appl. No.: 14/949,839

(22) Filed: Nov. 23, 2015

(65) Prior Publication Data

US 2016/0183703 A1 Jun. 30, 2016

(30) Foreign Application Priority Data

Dec. 31, 2014 (CN) ..... 2014 2 0871559 U
Dec. 31, 2014 (CN) ..... 2014 2 0872015 U
Dec. 31, 2014 (CN) ..... 2014 2 0872322 U

(51) Int. Cl.
*A47G 19/22* (2006.01)

(52) U.S. Cl.
CPC ..... *A47G 19/2272* (2013.01); *A47G 19/2288* (2013.01)

(58) Field of Classification Search
CPC ..... A47G 19/2272; A47G 19/2288; A47G 19/2266; B65D 81/3865; B65D 1/265; B65D 43/20; B65D 43/12; B65D 51/1644; B65D 50/046; B65D 50/045; B65D 90/58; B65D 90/587; B65D 47/06; B65D 47/32
USPC ..... 220/592.17, 715, 714, 711, 812, 811, 220/810, 281, 345.6, 345.1, 203.04, 220/203.01; 222/562, 559, 547, 545, 544, 222/481, 481.5, 482, 483, 484; 403/337, 403/335, 361, 345
See application file for complete search history.

(56) References Cited

U.S. PATENT DOCUMENTS 1,660,455 A * 2/1928 Plumb ..... E21B 17/043 285/390
3,390,897 A * 7/1968 Moore ..... F16L 15/006 285/305
3,739,938 A * 6/1973 Paz ..... A47G 19/2272 215/309
3,964,631 A * 6/1976 Albert ..... B65D 47/249 220/254.3
7,546,933 B2 * 6/2009 Pinelli ..... A47G 19/2272 220/714
2013/0140309 A1 * 6/2013 George ..... A47G 19/2272 220/254.1

* cited by examiner

*Primary Examiner* — Robert J Hicks
(74) *Attorney, Agent, or Firm* — Prakash Nama; Global IP Services, PLLC

(57) ABSTRACT

A thermo mug having a mug cover and a mug body, a water discharge opening and a steam discharge opening provided on the mug cover, a valve provided in the mug cover for controlling the steam discharge opening to open first and then the water discharge opening to open subsequently, and a press button connected with the valve and provided at one side of the mug cover. The press button controls the valve to move. The present invention has a simple structure which allows discharge of the steam first and then the discharge of water by using one single button so that users will not scald themselves by the discharged hot steam.

8 Claims, 7 Drawing Sheets

THERMO MUG

BACKGROUND OF THE INVENTION

The present invention relates to a kind of improved thermo mug.

Currently, a thermo mug comprises a mug body and a cover provided at an opening of the mug body. Usually, the cover is provided with a water discharge valve on its top. When the water discharge valve is opened, water and steam are discharged through the water discharge valve. Users will therefore often scald themselves because of the discharged steam. Furthermore, this kind of thermo mug is not convenient to operate.

BRIEF SUMMARY OF THE INVENTION

In view of the aforesaid disadvantages now present in the prior art, the present invention provides a structurally simple thermo mug which can discharge the steam first and then the water by simply pressing and holding one button so that users will not scald themselves due to the discharged hot steam.

The thermo mug provided by the present invention comprises a mug cover and a mug body; a water discharge opening and a steam discharge opening are provided on the mug cover; a valve is provided inside the mug cover for controlling the steam discharge opening to open first and then the water discharge opening to open subsequently; the valve is connected with a press button provided at an outer side of the mug cover; the press button controls the valve to move; the valve comprises a water discharge valve rod and a steam discharge valve rod provided horizontally and arranged sequentially; a rear end of the water discharge valve rod adjacent to the steam discharge valve rod is provided with a trough along an axial direction; a front end of the steam discharge valve rod adjacent to the water discharge valve rod is partially inserted into the trough; the rear end of the water discharge valve rod is also provided with a through hole along a radial direction running through the trough of the water discharge valve rod; the through hole has a certain amount of width along the axial direction; a pin is provided in the through hole; the pin also penetrates through the front end of the steam discharge valve rod, so that the water discharge valve rod and the steam discharge valve rod are connected with each other and are mutually movable along the axial direction; the water discharge valve rod is sleeved with a front spring; a rear end of the front spring abuts against the pin; a front end of the front spring is fixed on the water discharge valve rod; the steam discharge valve rod is sleeved with a rear spring; a front end of the rear spring abuts against the pin; a rear end of the rear spring 24 is being securely fixed; a valve seat is provided inside the mug cover for supporting the valve; the valve is capable of reciprocating horizontally with respect to the valve seat; a water seal is provided on the water discharge valve rod; a steam seal is provided on the steam discharge valve rod; the water discharge opening and the steam discharge opening are oriented to different directions on the mug cover.

The present invention has the following additional features:

The mug cover comprises an outer cover and an inner cover; an accommodation space is formed between the outer cover and the inner cover; a main body part of the valve is disposed in the accommodation space; a seal ring is provided around an outer circumferential wall of a lower end of the inner cover, and the seal ring seals an inner circumferential wall of the mug body; a second water discharge opening corresponding to the water discharge opening is provided on the inner cover; the steam discharge opening is provided on the inner cover; a water channel is provided between the water discharge opening and the second water discharge opening; the water seal extends into the water channel.

The inner cover is connected with a removable wash cover.

When the mug cover covers on the mug body, a press and hold portion of the press button is positioned at an upper middle part of the mug body.

The wash cover is connected with the inner cover by screw threads; a second seal ring is provided between the wash cover and the inner cover.

The press button is provided vertically at one side of the outer cover; a second through hole corresponding to the valve is provided on the outer cover; an upper end of the press button is connected with a rear end of the steam discharge valve rod 21 via the second through hole; a rear end of the press button is the press and hold portion; a middle part of the press button is hinged onto the outer cover via a second pin.

An outer case is provided on the outer cover to cover up the press button; a press button hole is provided on the outer case to expose the press and hold portion of the press button.

The thermo mug provided by the present invention has the following advantages compared with the prior arts: The present invention is a structurally simple thermo mug which can discharge the steam first and then the water by simply pressing and holding one button so that users will not scald themselves due to the discharged hot steam. Furthermore, since the press and hold portion of the press button is provided at an upper middle part of the mug body, users may simply hold the mug body by using one hand and then press and hold the press button by using a single finger to drink water from the mug. When finish drinking, users may release the press button to immediately seal the water inside the mug again. The present invention can be easily and conveniently operated and is therefore suitable to be used by different users in different circumstances. Also, cleaning of the valve of the present invention is easy.

BRIEF DESCRIPTION OF THE DRAWINGS

The present invention will be described in detail below with reference to an embodiment and the accompanying drawings.

DETAILED DESCRIPTION OF THE INVENTION

Figure 1:
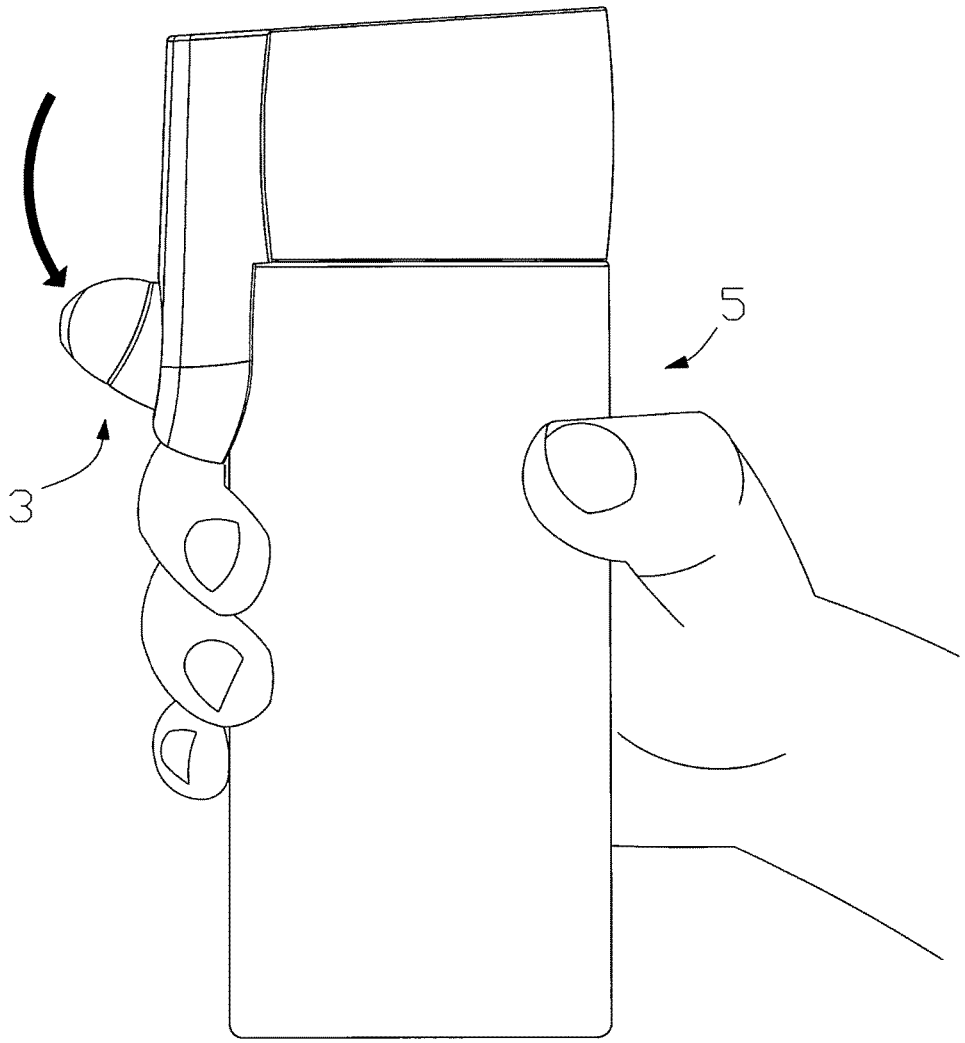
FIG. 1 shows an outer shape of the thermo mug according to the present invention.
Figure 2:
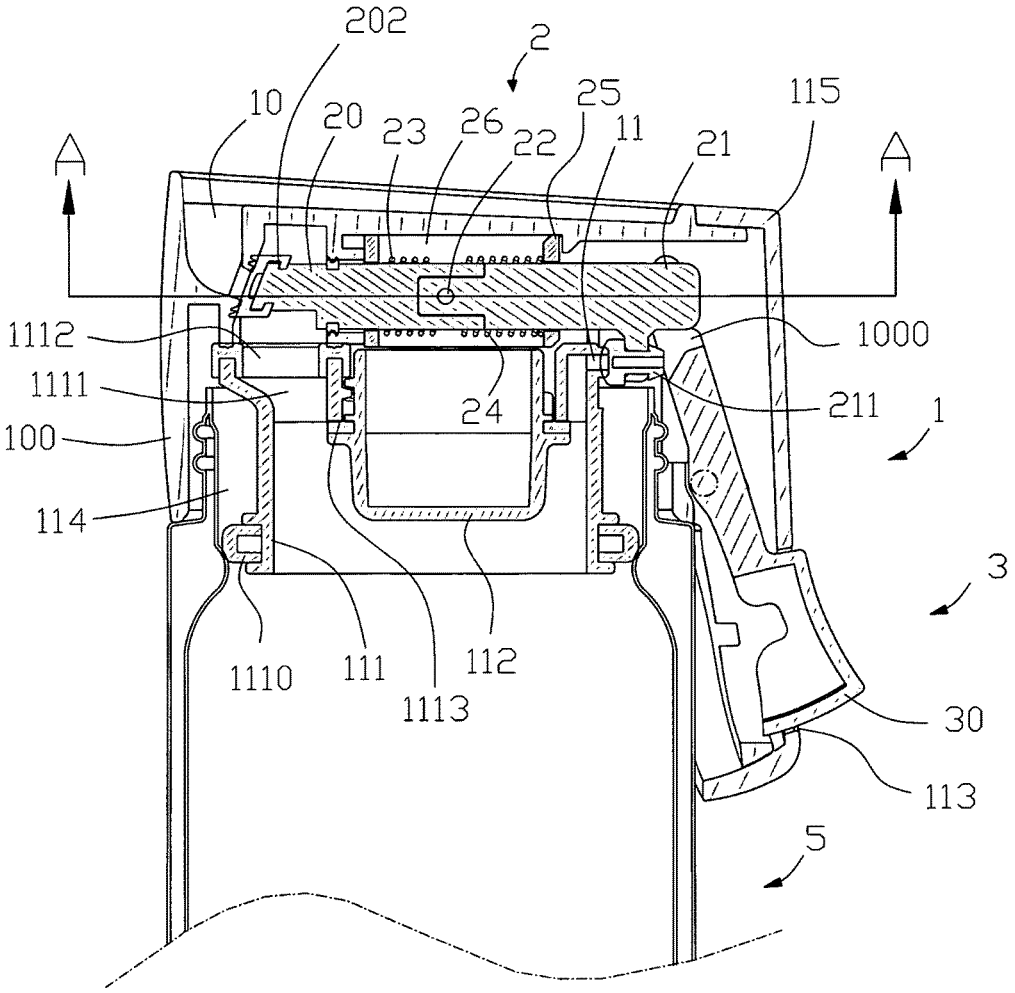
FIG. 2 is a sectional view of the thermo mug according to the present invention wherein the water discharge opening and the steam discharge opening are both sealed.
Figure 3:
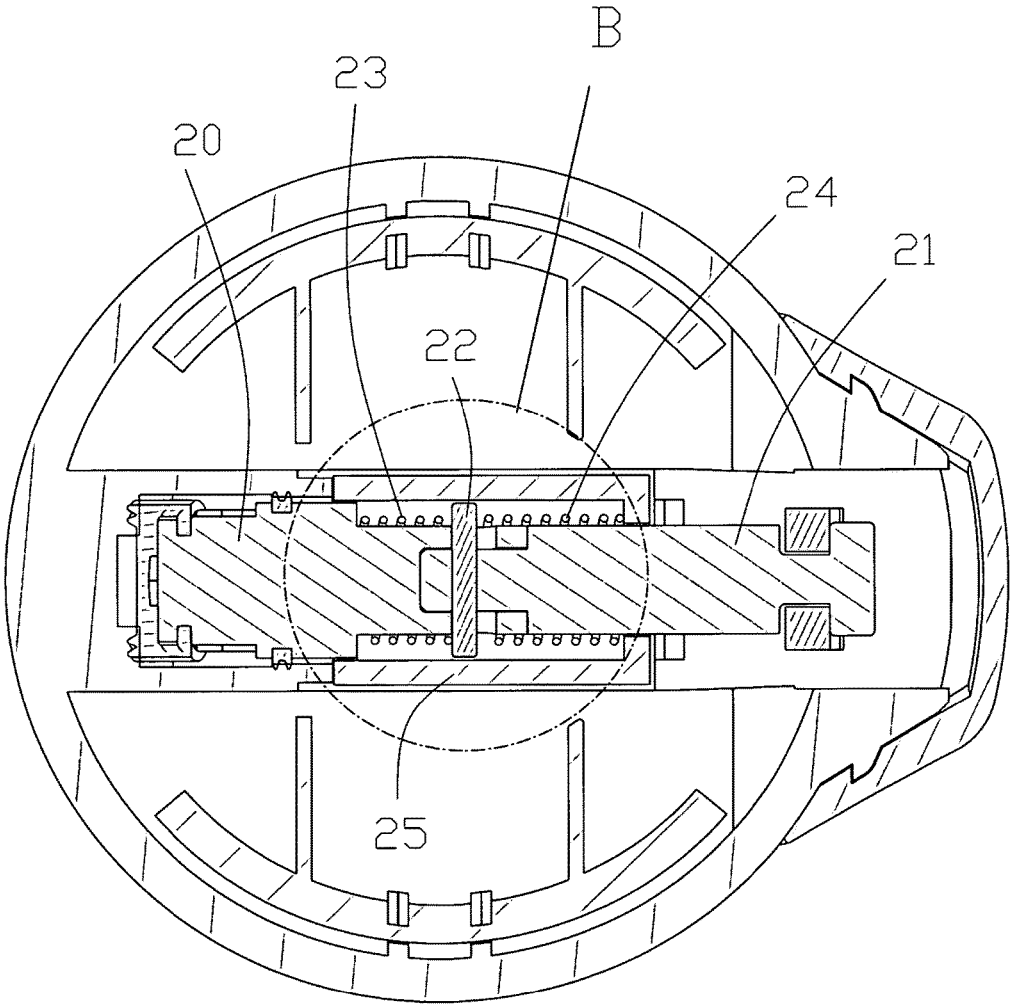
FIG. 3 is a sectional view along line A-A shown in FIG. 2.
Figure 4:
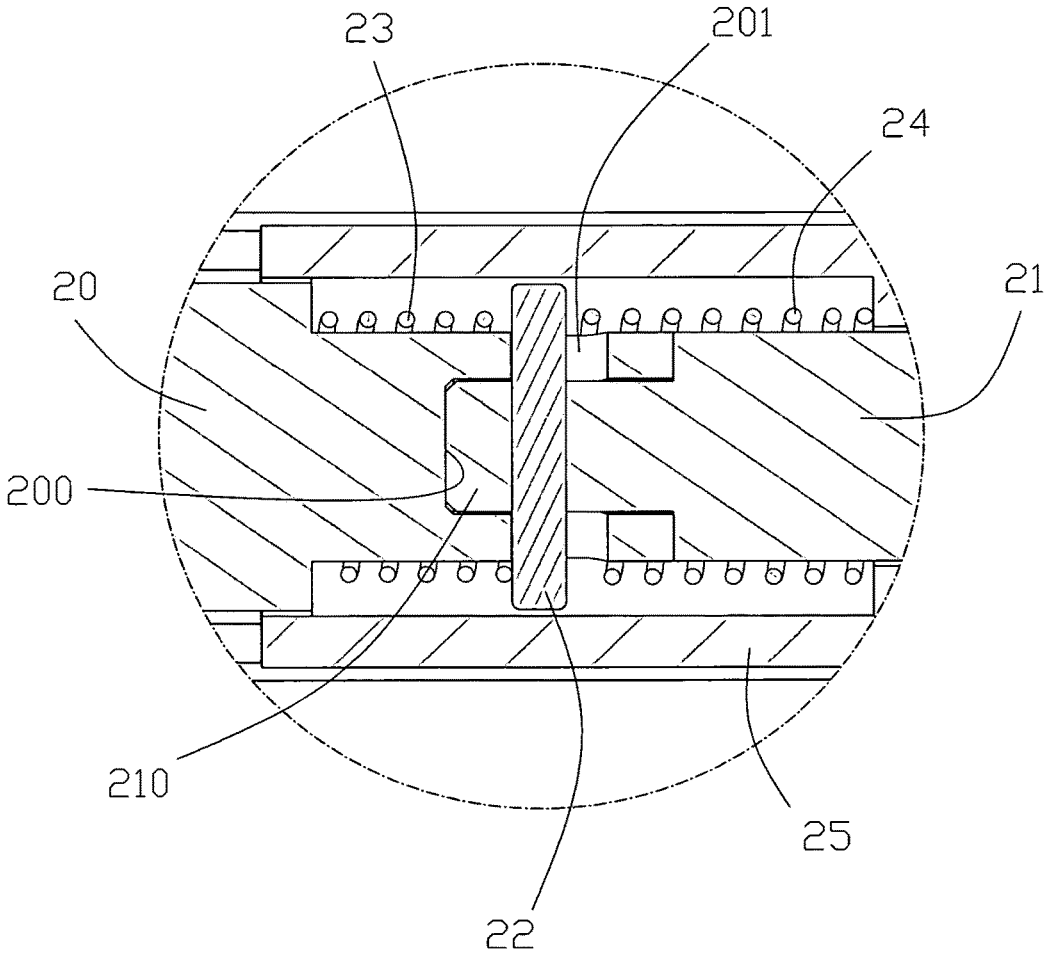
FIG. 4 is an enlarged view of portion B shown in FIG. 3.
Figure 5:
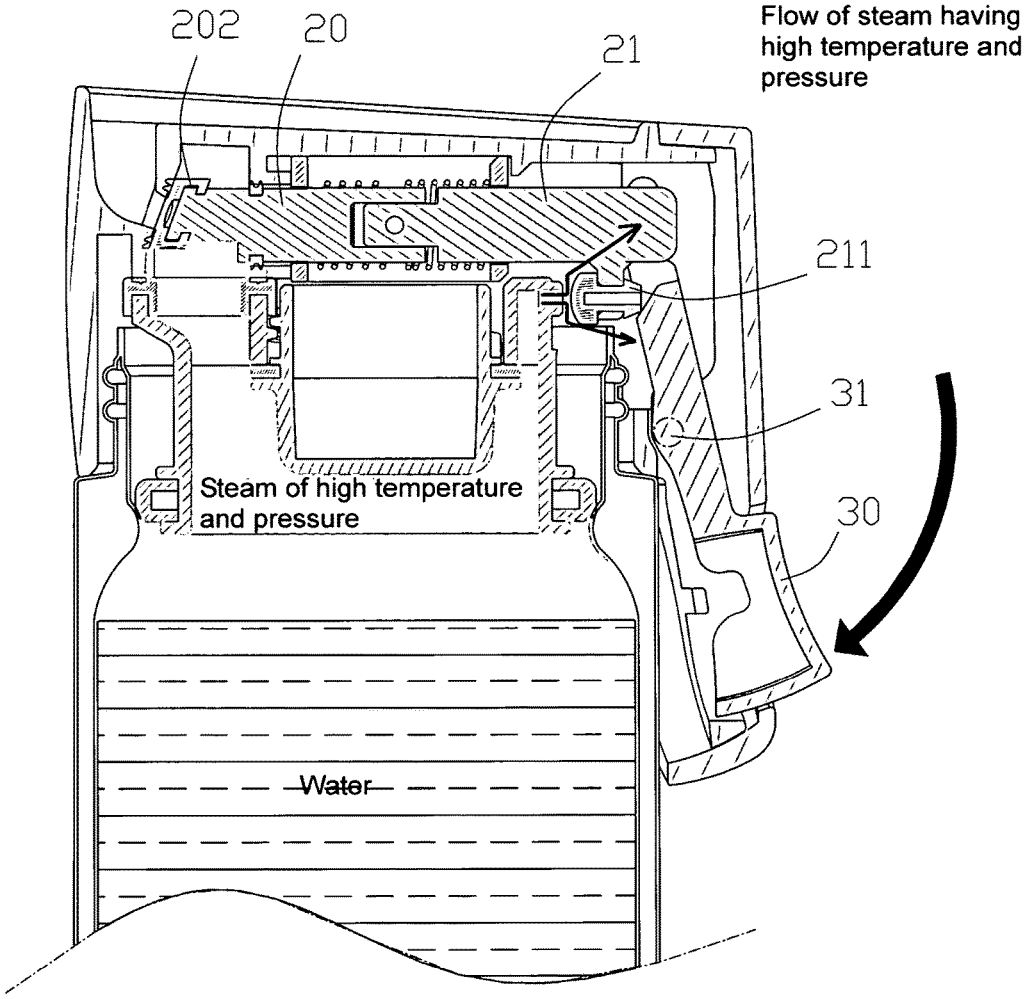
FIG. 5 is a schematic view of the present invention wherein the steam discharge opening is opened and the water discharge opening is sealed.
Figure 6:
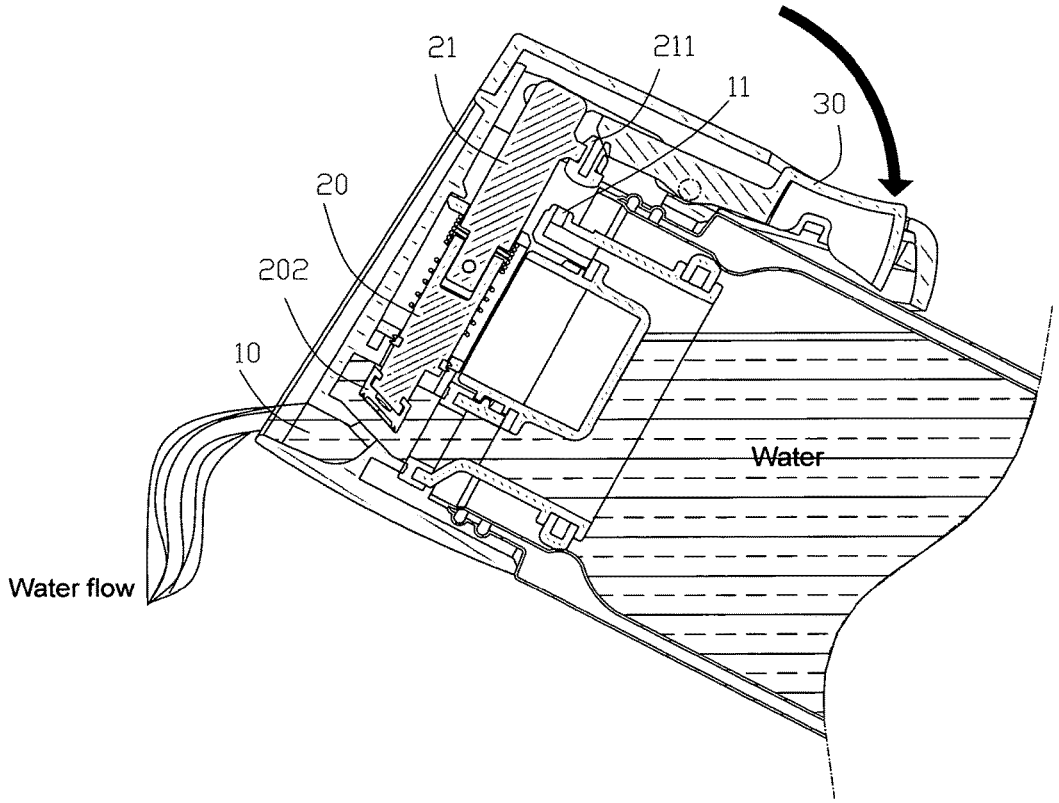
FIG. 6 is a schematic view of the present invention wherein the steam discharge opening and the water discharge opening are both opened.
Figure 7:
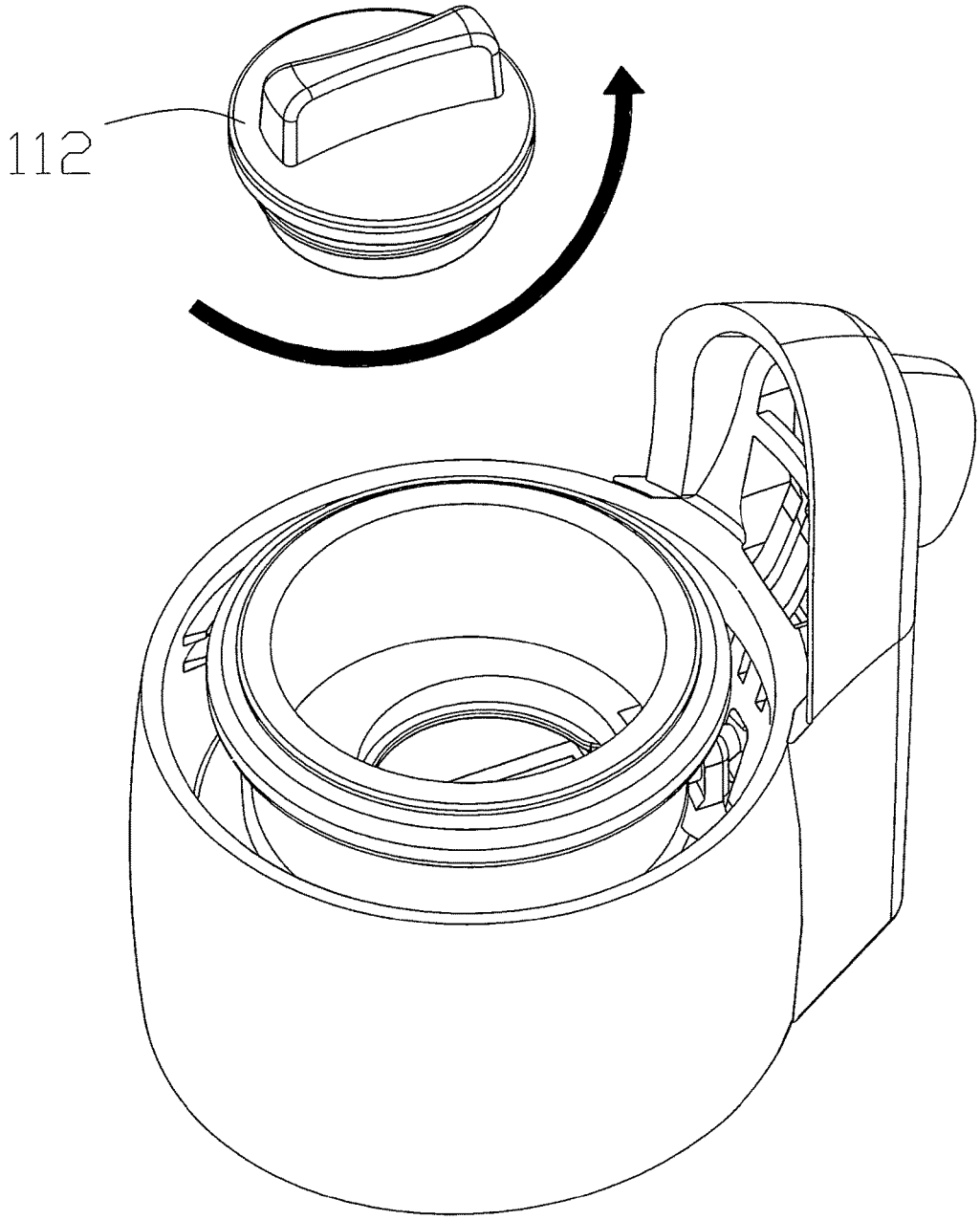
FIG. 7 is a structural view showing how the wash cover is to be fitted with the inner cover.

FIGS. 1-7 show a preferred embodiment of the thermo mug according to the present invention. The thermo mug comprises a mug cover 1 and a mug body 5. A water discharge opening 10 and a steam discharge opening 11 are provided on the mug cover 1. A valve 2 is provided inside the mug cover for controlling the steam discharge opening to open first and then the water discharge opening to open subsequently. The valve 2 is connected with a press button 3 provided at an outer side of the mug cover. The press button 3 controls the valve 2 to move. The valve 2 comprises a water discharge valve rod 20 and a steam discharge valve rod 21 provided horizontally and arranged sequentially. A rear end of the water discharge valve rod 20 adjacent to the steam discharge valve rod 21 is provided with a trough 200 along an axial direction. A front end 210 of the steam discharge valve rod adjacent to the water discharge valve rod is partially inserted into the trough 200. The rear end of the water discharge valve rod 20 is also provided with a through hole 201 along a radial direction running through the trough 200 of the water discharge valve rod 20. The through hole 201 has a certain amount of width along the axial direction. A pin 22 is provided in the through hole 201. The pin 22 also penetrates through the front end 210 of the steam discharge valve rod 21. Therefore, the water discharge valve rod 20 and the steam discharge valve rod 21 are connected with each other and are mutually movable along the axial direction. The water discharge valve rod 20 is sleeved with a front spring 23. A rear end of the front spring 23 abuts against the pin 22; a front end of the front spring 23 is fixed on the water discharge valve rod 20. The steam discharge valve rod is sleeved with a rear spring 24. A front end of the rear spring 24 abuts against the pin 22; a rear end of the rear spring 24 is being securely fixed. A valve seat 25 is provided inside the mug cover 1 for supporting the valve 2. The rear end of the rear spring 24 is being securely fixed on the valve seat 25. The valve 2 is capable of reciprocating horizontally with respect to the valve seat 25. A water seal 202 is provided on the water discharge valve rod 20. A steam seal 211 is provided on the steam discharge valve rod 21. The water discharge opening 10 and the steam discharge opening 11 are oriented to different directions on the mug cover 1.

In the present invention, the mug cover 1 comprises an outer cover 100 and an inner cover 111. An accommodation space 26 is formed between the outer cover 100 and the inner cover 111. A main body part of the valve is disposed in the accommodation space 26. A seal ring 1110 is provided around an outer circumferential wall of a lower end of the inner cover 111, and the seal ring 1110 seals an inner circumferential wall of the mug body 5. A second water discharge opening 1111 corresponding to the water discharge opening 10 is provided on the inner cover 111. The steam discharge opening is provided on the inner cover 111. A water channel 1112 is provided between the water discharge opening 10 and the second water discharge opening 1111. The water seal 202 extends into the water channel 1112.

In the present invention, when the mug cover 1 covers the mug body 5, a press and hold portion 30 of the press button 3 is positioned at an upper middle part of the mug body 5. Due to such a position of the press and hold portion 30, users may hold the mug by using one single hand and drink water from the mug by pressing and holding the press button using one single finger. When users finish drinking water from the mug, release the press button so that water is again sealed inside the mug. Accordingly, the present invention is simple and easy to operate and is suitable for use by different users in different circumstances. The press button 3 is provided vertically at one side of the outer cover 100. A second through hole 1000 corresponding to the valve 2 is provided on the outer cover 100. An upper end of the press button 3 is connected with a rear end of the steam discharge valve rod 21 via the second through hole 1000. A rear end of the press button 3 is the press and hold portion 30. A middle part of the press button is hinged onto the outer cover 100 via a second pin 31. An outer case 115 is provided on the outer cover 100 to cover up the press button 3. A press button hole 113 is provided on the outer case 115 to expose the press and hold portion 30 of the press button 3. Accordingly, the present invention has a more aesthetically pleasing outer appearance.

In the present invention, the inner cover 111 is connected with a removable wash cover 112. The wash cover 112 is connected with the inner cover 111 by screw threads. A second seal ring 1113 is provided between the wash cover 112 and the inner cover 111. When it is required to clean and wash the main body part of the valve, simply dismount the wash cover 112 to clean and wash the main body part of the valve. After mounting the wash cover 112, the main body part of the valve will be concealed in a sealed cavity. Accordingly, the mug cover has a more aesthetically pleasing outer appearance.

In the present invention, a space 114 for accommodating an upper portion of the mug body is formed between the outer circumferential wall of the inner cover 111 and an inner circumferential wall of the outer cover 100. The upper portion of the mug body extends into the space 114 and is connected with the inner circumferential wall of the outer cover 100 by screw threads.

A person skilled in this field of art should note that the front spring 23 and the rear spring 24 are both compressed prior to pressing the press button. The directions "left" and "right" as will be described below are based on the left and right directions shown in FIG. 2: In the beginning, the pin 22 is positioned at a far left position in the through hole 201; during use of the present invention, press the press and hold portion 30 so that the press button 3 rotates about the second pin 31 and then drives the steam discharge valve rod 21 to move rightward; since the pin 22 also penetrates through the front end 210 of the steam discharge valve rod 21, the pin 22 will also move rightward in and along the through hole 201; during rightward movement of the pin 22, the rear spring 24 will be continuously compressed; the steam seal 211 will then open for the steam to discharge through the steam discharge opening 11; before the pin reaches a far right position in the through hole 201, the water discharge opening 10 is still being sealed because the pin 22 has moved rightward only in the through hole 201 and so the pin 22 does not drive the water discharge valve rod 20 to move rightward; during the rightward movement of the pin 22, a right end of the front spring 23 abutting against the pin 22 will also move rightward along with the pin 22 so that compression of the front spring 23 is partially released; while compression of the front spring 23 is partially released, compression of the front spring 23 is still partially maintained such that compression force of the front spring 23 still biases the water seal 202 to abut against the water discharge opening 10; therefore, when discharging the steam, the water discharge opening 10 is still being sealed; when the pin 22 reaches the far right position in the through hole 201, the pin 22 abuts against the water discharge valve rod 20; the pin 22 can then drive the water discharge valve rod 20 to move rightward so as to open the water discharge opening. The present invention provides a thermo mug which can discharge the steam first and then the water by simply pressing one button so that users will not scald themselves due to the discharged hot steam. Once finish discharging water from the mug, simply release the press button to reset the steam discharge valve rod 21 and the water discharge valve rod 20 under the action of the rear spring 24.

The embodiment described above is intended only for explaining the present invention. The embodiment should not be taken as limiting. Different kinds of changes and variations of the present invention can be made by a person skilled in this field of art without deviating from the essence and scope of the present invention. Therefore, all equivalent alternatives should be considered falling within the scope of the present invention.

What is claimed is:

1. A thermo mug, comprising a mug cover and a mug body; a water discharge opening and a steam discharge opening are provided on the mug cover; a valve is provided inside the mug cover for controlling the steam discharge opening to open first and then the water discharge opening to open subsequently; the valve is connected with a press button provided at an outer side of the mug cover; the press button controls the valve to move; the valve comprises a water discharge valve rod and a steam discharge valve rod provided horizontally and arranged sequentially; a rear end of the water discharge valve rod adjacent to the steam discharge valve rod is provided with a trough along an axial direction; a front end of the steam discharge valve rod adjacent to the water discharge valve rod is partially inserted into the trough; the rear end of the water discharge valve rod is also provided with a through hole along a radial direction running through the trough of the water discharge valve rod; the through hole has a width along the axial direction; a pin is provided in the through hole; the pin also penetrates through the front end of the steam discharge valve rod, so that the water discharge valve rod and the steam discharge valve rod are connected with each other and are mutually movable along the axial direction; the water discharge valve rod is sleeved with a front spring; a rear end of the front spring abuts against the pin; a front end of the front spring is fixed on the water discharge valve rod; the steam discharge valve rod is sleeved with a rear spring; a front end of the rear spring abuts against the pin; a rear end of the rear spring is securely fixed; a valve seat is provided inside the mug cover for supporting the valve; the valve is capable of reciprocating horizontally with respect to the valve seat; a water seal is provided on the water discharge valve rod; a steam seal is provided on the steam discharge valve rod; the water discharge opening and the steam discharge opening are oriented to different directions on the mug cover.

2. The thermo mug as in claim 1, wherein the mug cover comprises an outer cover and an inner cover; an accommodation space is formed between the outer cover and the inner cover; a main body part of the valve is disposed in the accommodation space; a first seal ring is provided around an outer circumferential wall of a lower end of the inner cover, and the first seal ring seals an inner circumferential wall of the mug body; a second water discharge opening corresponding to the water discharge opening is provided on the inner cover; the steam discharge opening is provided on the inner cover; a water channel is provided between the water discharge opening and the second water discharge opening; the water seal extends into the water channel.

3. The thermo mug as in claim 2, wherein the inner cover is connected with a removable wash cover.

4. The thermo mug as in claim 1, wherein when the mug cover covers on the mug body, a press and hold portion of the press button is positioned at an upper middle part of the mug body.

5. The thermo mug as in claim 3, wherein the wash cover is connected with the inner cover by screw threads; a second seal ring is provided between the wash cover and the inner cover.

6. The thermo mug as in claim 2, wherein the press button is provided vertically at one side of the outer cover, a second through hole corresponding to the valve is provided on the outer cover; an upper end of the press button is connected with a rear end of the steam discharge valve rod via the second through hole; a rear end of the press button is the press and hold portion; a middle part of the press button is hinged onto the outer cover via a second pin.

7. The thermo mug as in claim 6, wherein an outer case is provided on the outer cover to cover up the press button; a press button hole is provided on the outer case to expose the press and hold portion of the press button.

8. The thermo mug as in claim 2, wherein a space for accommodating an upper portion of the mug body is formed between the outer circumferential wall of the inner cover and an inner circumferential wall of the outer cover; the upper portion of the mug body extends into the space and is connected with the inner circumferential wall of the outer cover by screw threads.

* * * * *